US007013608B2

(12) United States Patent
Newland

(10) Patent No.: US 7,013,608 B2
(45) Date of Patent: Mar. 21, 2006

(54) SELF-GUYED STRUCTURES

(76) Inventor: Dennis John Newland, 2455 George Washington Way, Apt. A111, Richland, WA (US) 99352

( * ) Notice: Subject to any disclaimer, the term of this patent is extended or adjusted under 35 U.S.C. 154(b) by 567 days.

(21) Appl. No.: 09/895,763

(22) Filed: Jun. 28, 2001

(65) Prior Publication Data

US 2002/0002807 A1 Jan. 10, 2002

Related U.S. Application Data

(60) Provisional application No. 60/216,298, filed on Jul. 5, 2000.

(51) Int. Cl.
*E04H 12/20* (2006.01)

(52) U.S. Cl. ..... 52/146; 52/646; 52/148; 52/81.3; 52/648.1

(58) Field of Classification Search ..... 52/646, 52/146, 147, 148, 150, 152, 81.2, 81.3, 633, 52/648.1, 652.1; 343/915
See application file for complete search history.

(56) References Cited

U.S. PATENT DOCUMENTS 3,063,521 A 11/1962 Fuller
3,354,591 A * 11/1967 Fuller ..... 52/81.2
3,695,617 A * 10/1972 Mogilner et al. ..... 273/156
3,866,366 A * 2/1975 Fuller ..... 52/81.2
4,207,715 A 6/1980 Kitrick
4,449,348 A 5/1984 Jacobs
4,711,062 A 12/1987 Gwilliam et al.
4,731,962 A * 3/1988 Kittner et al. ..... 52/81.2
5,184,789 A * 2/1993 Aldrin ..... 244/159
5,642,590 A * 7/1997 Skelton ..... 52/81.1
5,688,604 A 11/1997 Matan et al.
5,757,335 A * 5/1998 Kaneff et al. ..... 343/840
5,822,945 A * 10/1998 Muller ..... 52/645
6,202,379 B1 * 3/2001 Meguro et al. ..... 343/915
6,205,737 B1 * 3/2001 Haussler ..... 52/649.1
6,313,811 B1 * 11/2001 Harless ..... 343/912
6,542,132 B1 * 4/2003 Stern ..... 343/915

FOREIGN PATENT DOCUMENTS

EP 0278939 * 1/1988

* cited by examiner

*Primary Examiner*—Carl D. Friedman
*Assistant Examiner*—Chi Q. Nguyen
(74) *Attorney, Agent, or Firm*—Santangelo Law Office, P.C.

(57) ABSTRACT

A series of static structures formed from a plurality of interconnected rigid compression members or struts and flexible tension members or guys (e.g. wire cables, chains or elastic cords) is disclosed. The struts are discontinuous in several embodiments of the invention, intersect at an internal or peripheral point in others, or radiate outwardly from an internal central point in still others. Different configurations of guy arrangements may be described and claimed for each of the embodiments of this invention. Self Guyed Structures (SGS's) can be utilized as a stand-alone module or modules can be combined by connecting them at any point on a strut or guy in a nested, or an adjacently attached configuration to assemble composite SGS 's.

24 Claims, 6 Drawing Sheets

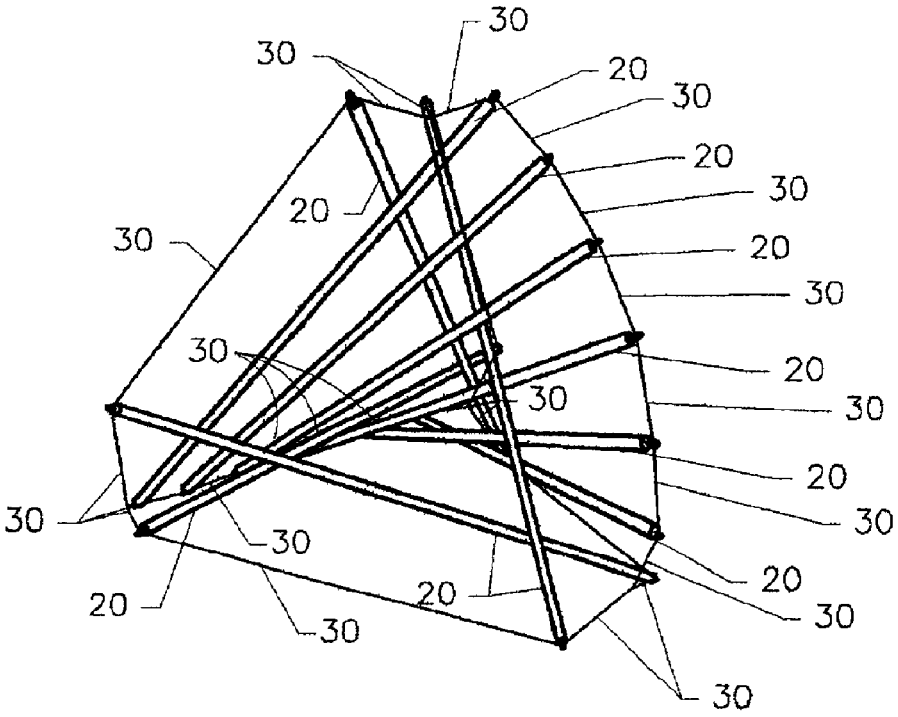
30
30
20
30
20
30
20
30
20
30
20
30
20
30
20
30
20
30
20
30
20
30
30
30

SELF-GUYED STRUCTURES

This is the Utility, nonprovisional Patent Application related to Provisional Patent application No. 60/216,298, filed Jul. 5, 2000, by Dennis J. Newland, hereby incorporated; this application claims benefit of priority of the provisional application.

STATEMENT REGARDING FEDERALLY SPONSORED RESEARCH OR DEVELOPMENT

Not applicable.

BACKGROUND OF THE INVENTION

This invention relates to three dimensional space defining and flexible guyed structures; U.S. CLASS: 52/646, 52/146.148.

This invention is an improvement of the prior art in that it includes new configurations of compression members or struts and tension members or guys to create new three dimensional free standing static structures having the ability to meet certain given design goals more economically and in more aesthetically pleasing arrangements. This invention also provides guy configurations that can be approximately two thirds the length of those required by the prior art for certain configurations.

The tensile-integrity (or tensegrity) sphere was introduced by Fuler (1962) in U.S. Pat. No. 3,063,521 as he used multiple modules of one variation of one embodiment of this invention e.g. a 3 discontinuous strut HYPERBOLOID SELF-GUYED STRUCTURE (SGS) with a circumferential configuration of guys to connect the strut ends in the "end-planes". At least one embodiment of this invention is an improvement of Fuler's in that it includes other guy configurations for the 3 discontinuous strut HYPERBOLOID SGS as well as including HYPERBOLOID SGS's of four or more struts, each with three guy configurations and also including strut arrangements which intersect at an internal or a peripheral point as well as the discontinuous configuration.

At least one embodiment of this invention is an improvement of these previous structures in that it may include additional guy configurations for these 6 and 3 strut PLANAR SGS's as well as maybe including 4,5 and 7 or more strut configurations, each with additional guy configurations and configurations where the strut planes are not necessarily orthogonal and configurations where struts intersect at an internal or a peripheral point as well as the discontinuous configuration.

Matan et al in U.S. Pat. No. 5,688,604 (1997) and Jacobs in U.S. Pat. No. 4,449,348 (1984) each devised structures composed of tension and compression members but in each case there was a twisting and/or a bending force on the compression members unlike at least one embodiment of this invention.

Much of the prior art has been limited to the configurations described above which have not enjoyed widespread use. At least one embodiment of this invention provides many additional configurations of the naturally material efficient structural design strategy of limiting structural elements to a purely compressional or a purely tensional load. By judicious choice of materials a wide range of strength, toughness, rigidity and/or flexibility and load response characteristics can be designed into these structures. By judicious combinations of SGS's either with other SGS's or with traditional structures, redundancy and failure tolerant designs can be achieved. Attractive and interesting as well as functional designs for applications where the structure will be visible are also advantages of this invention. At least one embodiment of these SGS's is pre-stressed and by varying this pre-stress load the designer can achieve differing structural characteristics (e.g. rigidity, resonance damping etc.) with the same structural elements. At least one embodiment of the SGS's can be made collapsible for ease of transportation or storage should collapsibility be a desirable feature of the structure being used.

Further advantages of this invention will become apparent from a consideration of the drawings and ensuing description.

U.S. Pat. Documents cited above or related to this invention are;

5,688,604 Nov. 1997 Matan et al 428/542.2
4,449,348 May 1984 Jacobs 52/648
4,207,715 Jun. 1980 Kitrick 52/81
4,711,062 Dec. 1987 Gwilliam et al 52/646
3,063,521 Nov. 1962 Fuller 189-34

BRIEF SUMMARY OF THE INVENTION

This invention is, in at least one embodiment, an improvement of the prior art in that it includes new configurations of compression members or struts and tension members or guys to create new static structures having the ability to meet certain given design goals more economically and in more aesthetically pleasing arrangements. Embodiments of this invention provide many additional configurations of the naturally material efficient structural design strategy of limiting structural elements to a purely compressional or a purely tensional load.

This invention, SELF-GUYED STRUCTURES (SGS's), is a series of three dimensional free standing static structures formed from a plurality of interconnected rigid compression members or struts and flexible tension members or guys (e.g. wire cables, chains or elastic cords). Each strut may be in pure compression (i.e. no bending or twisting forces) and each guy may be in pure tension. The struts are discontinuous in several variations and/or combinations of the embodiments of this invention, intersect at an internal or peripheral point in others, or radiate outwardly from an internal central point in still others. Embodiments (each with multiple variations) of this invention include; 1) HYPERBOLOID SGS's, 2) PLANAR SGS's, 3) HYP-PAR SGS's, 4) RADIS SGS's, and 5) POLYGONAL SGS's.

Different configurations of guy arrangement (may be claimed for each strut arrangement in embodiments. The guys can be configured in a 1) circumferential, 2) radial or 3) in an internal arrangement in addition to the obvious 4) linear arrangement.

By judicious choice of materials a wide range of strength, toughness, rigidity and/or flexibility and load response characteristics can be designed into these structures. By judicious combinations of SGS's either with other SGS's or with traditional structures, redundancy and failure tolerant designs can be achieved. Attractive and interesting as well as functional designs for applications where the structure will be visible are also advantages of this invention. These SGS's may be pre-stressed and by varying this pre-stress load the designer can achieve differing structural characteristics (e.g. rigidity, resonance damping etc.) with the same structural elements.

SGS's can be utilized as stand-alone modules or modules can be combined by connecting them at any point on a strut or guy in a nested, or an adjacently attached configuration to assemble composite SGS's. SGS's can similarly be combined with traditional structures to form additional composite structures.

At least some embodiments of SGS's can be made collapsible by utilizing a means of disconnecting the guys from the struts and/or utilizing a means to elongate selected guys or shortening selected struts.

DESCRIPTION OF DRAWINGS

In the FIGS. of the drawings struts are labeled as 20 and guys are labeled as 30, 30*a*, 30*b*, . . . etc.

FIG. 4A is a 10 discontinuous strut HYP-PAR SGS with one of the three hyperbolic paraboloid surfaces having six struts and the other two having two each. This structure has a radial arrangement of guys between the edge struts of each of the three hyperbolic paraboloid surfaces (the ends of these edge struts form four"end planes" where the tetrahedron is truncated and the edge struts are also oriented in a HYPERBOLOID configuration with respect to each other) and a linear arrangement of guys between the struts of the single 6 and the two 2 strut hyperbolic paraboloid surfaces.

FIG. 4B is a 20 discontinuous strut HYP-PAR SGS which consists of two 10 strut hyperbolic paraboloid surfaces intersecting each other at a centerline between the fifth and sixth strut of each surface. A linear arrangement of guys between each strut is used which results in two warped loops which also intersect each other at the centerline of the hyperbolic paraboloid surfaces.

DETAILED DESCRIPTION OF THE INVENTION

Figure 1A:
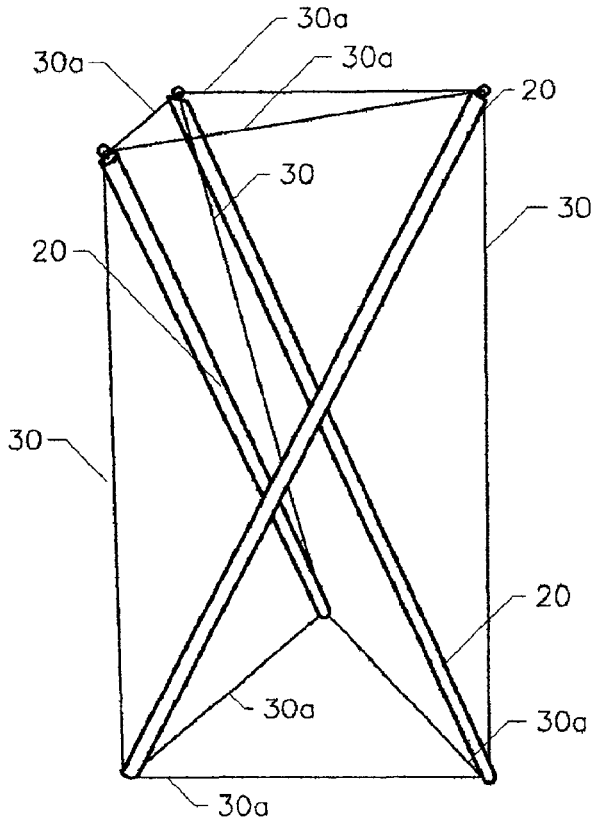
FIG. 1A is the 3 discontinuous strut tensile-integrity structure patented by Fuler. The "end-plane" guys (30*a*) are configured in a circumferential arrangement e.g. there is a guy on each edge of the top and bottom faces of this structure.
Figure 1B:
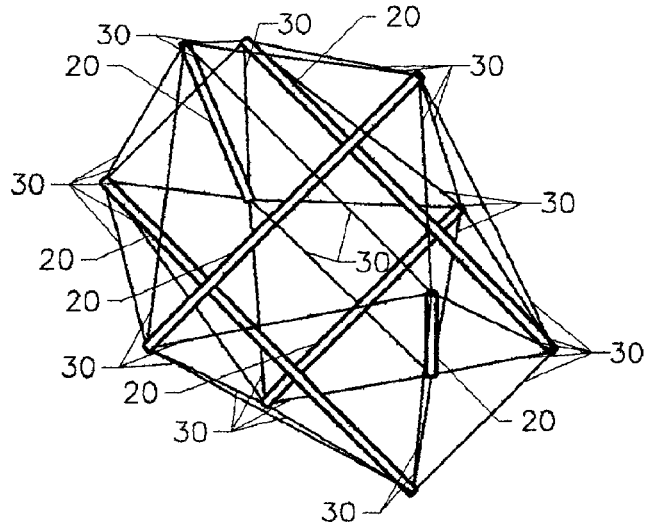
FIG. 1B is a 6 discontinuous strut tensile-integrity structure patented by Kitrick. Each of the twenty faces of this icosahedral tensile-integrity structure has a circumferential arrangement of guys e.g. one guy (30) along each edge of each of the twenty faces (most readily seen in the upper left region of the figure).

This invention is a series of three dimensional, free standing static structures titled SELF-GUYED STRUC- TURES (SGS's). They may be composed of a plurality of compression and tension members The compression members or struts may be in pure compression (i.e. no bending or twisting forces) and the tension members or guys (e.g. wire cables, chains or elastic cords) may be in pure tension and have both ends attached to the structure itself, not an external anchor point. The struts are discontinuous in several variations and/or combinations of embodiments of this invention, intersect at an internal or peripheral point in others, or radiate outwardly from an internal central point in still others. Embodiments (described in more detail below) of this invention include:1) HYPERBOLOID SGS's, 2) PLANAR SGS's, 3) HYP-PAR SGS's, 4) RADIS SGS's, and 5) POLYGONAL SGS's.

Different configurations of guy arrangement may be claimed for each strut arrangement in embodiments. The guys can be configured in a 1) circumferential, 2) radial or 3) internal arrangement (described in more detail below).

By judicious choice of materials a wide range of strength, toughness, rigidity and/or flexibility and load response characteristics can be designed into these structures. By judicious combinations of SGS's either with other SGS's or with traditional structures, redundancy and failure tolerant designs can be achieved. Attractive and interesting as well as functional designs for applications where the structure will be visible are also advantages of this invention. These SGS's may be pre-stressed and by varying this pre-stress load the designer can achieve differing structural characteristics (e.g. rigidity, resonance damping etc.) with the same structural elements.

SGS's can be utilized as stand-alone modules or modules can be combined by connecting them at any point on a strut or guy in a nested, or an adjacently attached configuration to assemble composite SGS's. SGS's can similarly be combined with traditional structures to form additional composite structures.

At least some embodiments of these SGS's can be made collapsible by utilizing a means of disconnecting the guys from the struts and/or utilizing a means to elongate selected guys or shortening selected struts.

Several embodiments as well as multiple variations of each embodiment of these SELF-GUYED STRUCTURES (SGS's). are included in this invention.

1) At least one embodiment of the HYPERBOLOID SGS's may comprise three or more struts (labeled as 20 in FIGS. 1A, 2A, 2B, 2C and 2D arranged on the surface of a hyperboloid of revolution of one sheet. The struts are discontinuous in several variations of this embodiment and intersect at an internal or a peripheral point in other variations. The term discontinuous is used to mean the struts do not touch each other in the construction of the SGS and it means they do not intersect each other either internally or on the periphery of the SGS. The vertical guys (labeled as 30 in FIGS. 1A, 2A, 2B, 2C and 2D may lie on the surface of a separate hyperboloid of revolution of one sheet. These structures may be enantiomorphic in that struts and vertical guys can have a left handed or a right handed helicity. The lengths of the struts can be equal or of different length and although the length of each strut must span the mid-plane of the hyperboloid of revolution they need not have equal lengths on either side of the mid-plane. The roughly circular arrangement of strut ends on either side of the mid-plane form what are called"end-planes". In the simpler variations the strut ends/guy attachment points which define"end-planes" are indeed planes and are parallel to the mid-plane of the hyperboloid of revolution. In other variations the strut ends/guy attachment points need not form a true plane nor do they need to be parallel to the mid-plane. Non-parallel"end-planes" and/or non-equal length struts would allow design options for combinations of structures to exhibit a curvature. However the term"end-planes" will be used to label this part (connected by guys labeled 30*a*, 30*b*, 30*c* or 30*d* of FIGS. 1A, 2A, 2B, 2C and 2D) of the HYPERBOLOID SGS. FIGS. 1A, 2A, 2B, 2C and 2D are only four of the many possible variations of the HYPERBOLOID SGS embodiment claimed as a part of this invention. Additional guy configurations may be claimed for each variation of the HYPERBOLOID SGS's embodiment as described below.

Figure 3A:
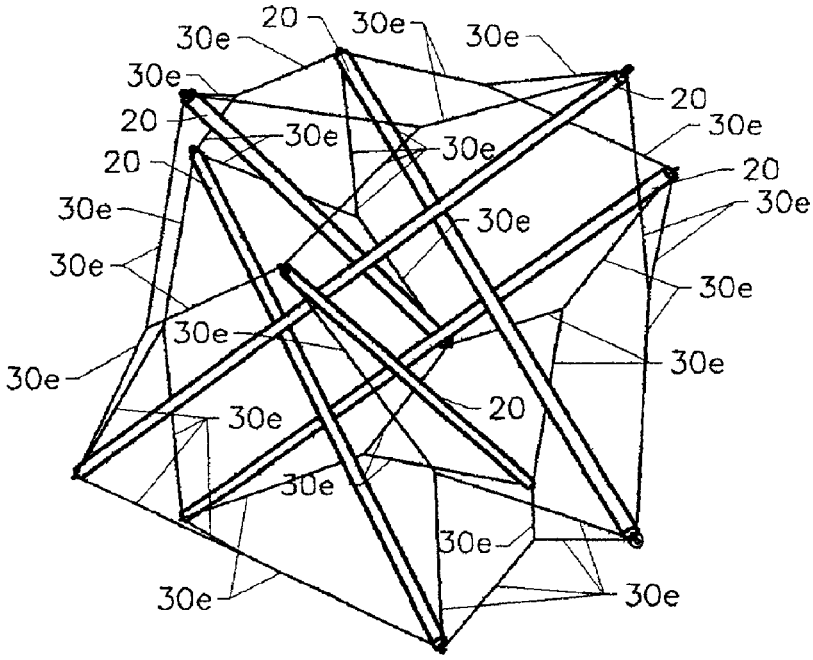
FIG. 3A is a 6 discontinuous strut PLANAR SGS with a radial arrangement of guys (30*e*) in only 12 of the 20 faces (all that is required for structural integrity) of the icosahedron as contrasted to the circumferential guy arrangement of FIG. 1B (which requires 30 guys). This radial configuration represents the minimal total length of guy members for the case of the icosahedron with guys on an edge or in the face planes. The radial configuration requires only 69% of the length required with the circumferential arrangement of FIG. 1B.
Figure 3B:
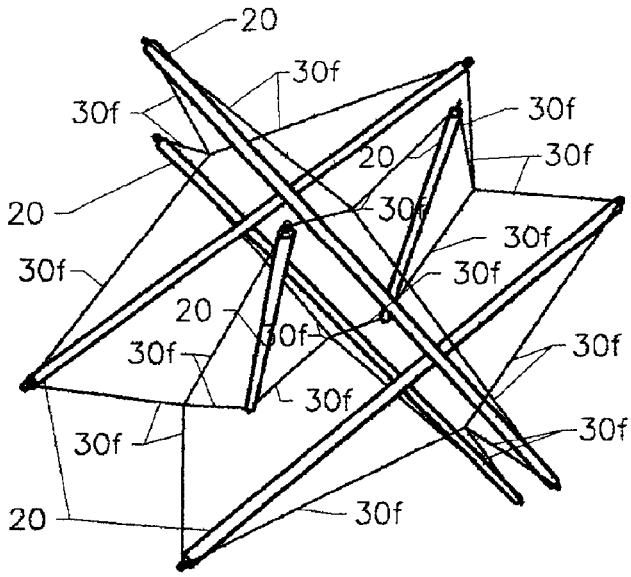
FIG. 3B is a 6 discontinuous strut PLANAR SGS with an internal guy arrangement (30*f*) which also can be used to reduce the total length of guy members necessary to provide structural integrity to the icosahedron or to achieve other design goals.

2) At least one embodiment of PLANAR SGS's may have a minimum of three struts defining a minimum of three planes (there can also be four or more planes) which intersect as necessary to form a three dimensional structure with integrity. These planes can be, but do not necessarily have to be, orthogonal to each other nor does each strut in a given plane need to be parallel to the other struts in the same plane. These struts are discontinuous in several variations of this embodiment and intersect at an internal or a peripheral point in other variations. FIGS. 3A and 3B are only two of the many variations of the PLANAR SGS embodiment claimed as a part of this invention. Additional guy configurations may be claimed for each variation of the PLANAR SGS's embodiment as described below.

3) At least one embodiment of HYP-PAR SGS's may have struts which lie on a hyperbolic paraboloid surface. At least one embodiment of these SGS's has a minimum of four struts two in each of two hyperbolic paraboloid surfaces which intersect as necessary to form a three dimensional structure with integrity. These surfaces can be, but need not necessarily be, orthogonal to each other. Also there can be more than 2 hyperbolic paraboloid surfaces. The struts are discontinuous in several variations of this embodiment and intersect at an internal or a peripheral point in other variations. FIGS. 4A and 4B are only two of the many variations of the HYP-PAR SGS embodiment claimed as a part of this invention. Additional guy configurations may be claimed for each variation of the HYP-PAR SGS's embodiment as described below.

Figure 5A:
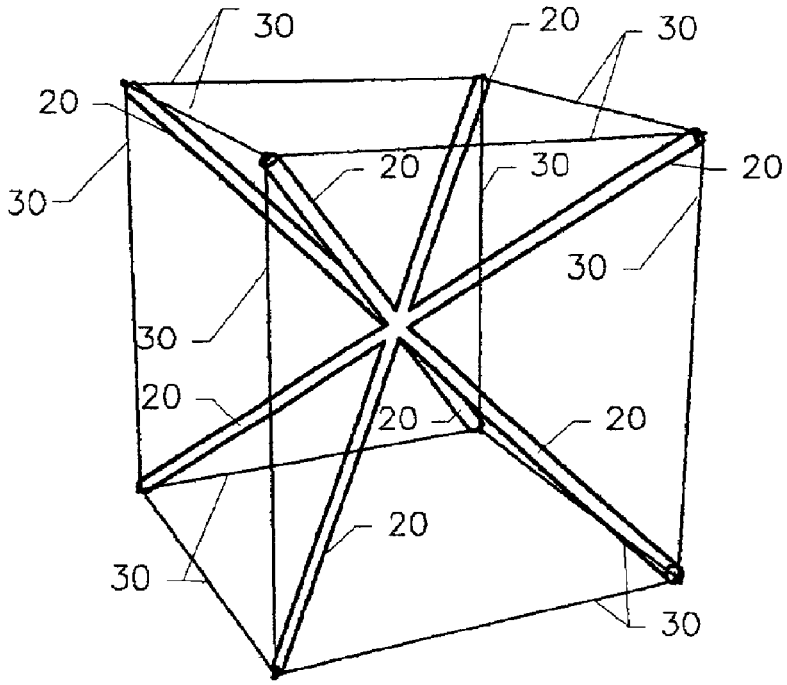
FIG. 5A is an 8 strut RADIAL SGS whose external strut ends form the vertices of a cube and with a circumferential arrangement of guys in each of the six square faces of the cube. The internal strut ends intersect at a central point within the cube (although not necessarily the exact center of the cube).
Figure 5B:
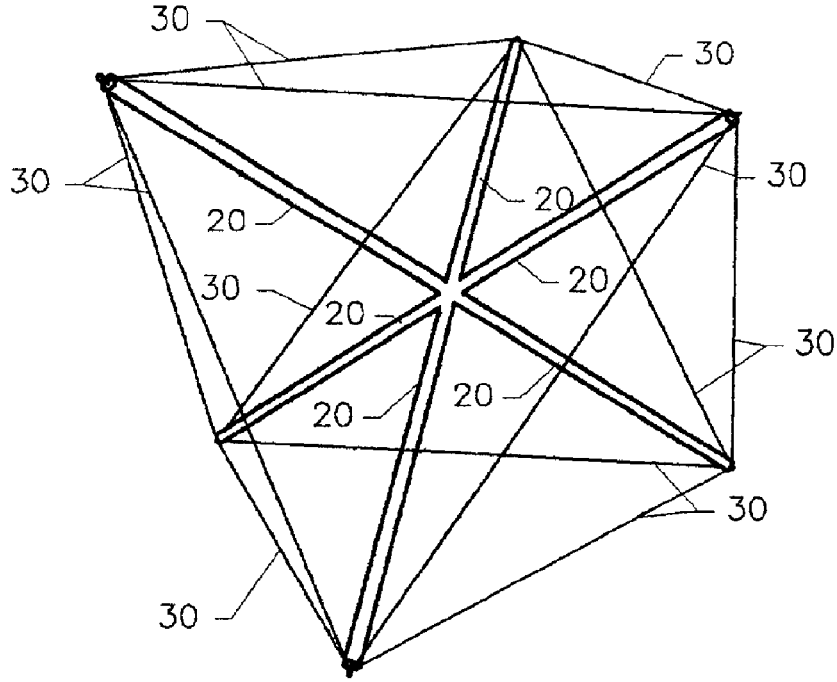
FIG. 5B is a 6 strut RADIAL SGS whose external strut ends form the vertices of an octahedron with a circumferential arrangement of guys in each of the eight triangular faces of the octahedron. The internal strut ends intersect at a central point within the octahedron (although not necessarily at the center of the octahedron).

4) At least one embodiment of RADIAL SGS's has four or more struts arranged such that compressive forces are radially vectored from an internal central point. The inward strut ends may all connect at this internal central point. The internal central point need not be the exact center of the polygon but must be internal to the polygonal faces whose vertices are defined by the guy connections to the outward ends of the struts. FIGS. 5A and 5B are only two of the many variations of the RADIAL SGS embodiment claimed by this invention. Additional guy configurations may be claimed for each of these RADIAL SGS's as described below.

Figure 6A:
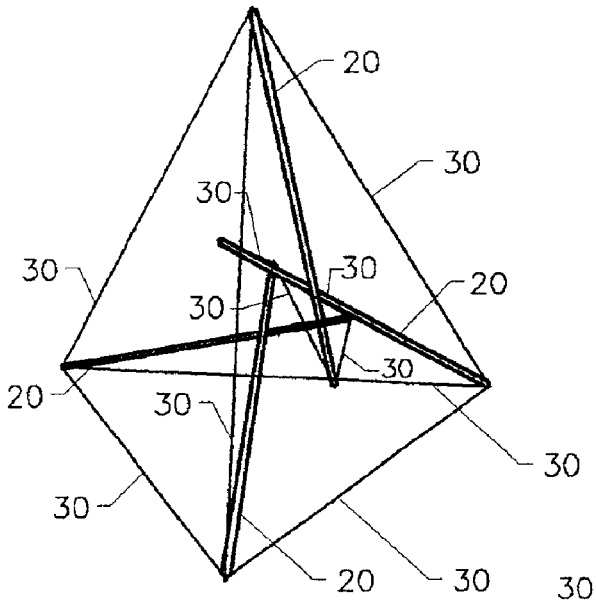
FIG. 6A is a 4 discontinuous strut POLYGONAL SGS whose outer strut ends form the vertices of a tetrahedron with a circumferential arrangement of guys in each of the 4 triangular faces of the tetrahedron. The inner ends of the struts do not intersect and, combined with the inner guys (arranged in a skewed quadralateral configuration), provide a radially outward force to react the inward force (created by the guys connecting the outer ends of the struts) resulting in structural integrity.
Figure 6B:
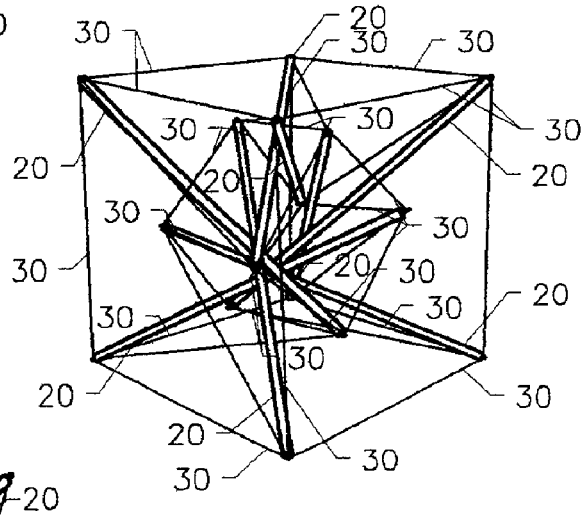
FIG. 6B is a 8 discontinuous strut POLYGONAL SGS's constructed by the combination of two overlapping 4 discontinuous strut HYPERBOLOID SGS's (with one "end-plane" smaller than the other and with the two smaller "end-planes" overlapping inside the outer cube) whose outer strut ends (from the larger "end-planes") become the vertices of a cube and whose inner strut ends do not intersect but do also form the vertices of a smaller inner cube rotated with respect to the outer cube. In this combination an additional four guys are added to complete the outer cube which act to increase the overlap of the two 4 discontinuous strut HYPERBOLOID SGS's while an additional four guys are also added to complete the inner cube and they act oppositely (e.g. to reduce the overlap) thus providing the necessary counter forces for structural integrity.
Figure 6C:
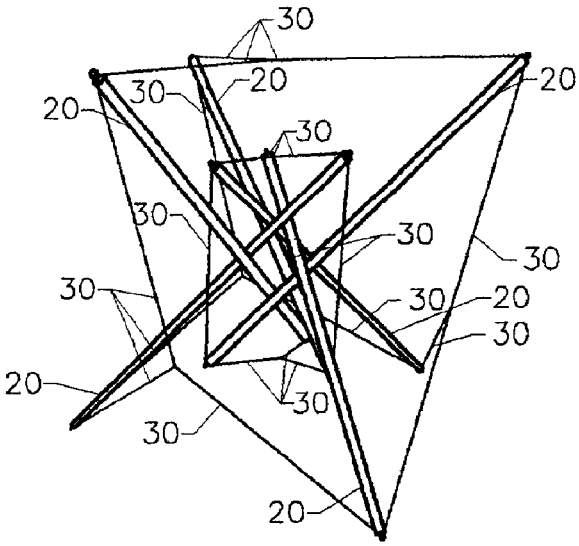
FIG. 6C is a 6 discontinuous strut POLYGONAL SGS's whose outer strut ends form the vertices of an octahedron with guys configured in a radial arrangement in only 4 of the 8 triangular faces of the octahedron (all that is required for structural integrity). This radial configuration of guys requires only 58% of the length required in the circumferential arrangement. The inner strut ends do not intersect and when combined with inner guys (configured as a twisted prism with radial guys in the "end-planes" of the prism and skewed guys forming the three twisted edges which connect the "end-planes" of the prism) provide the necessary outward counter force to react the inward force (created by the outer strut ends and their guys) resulting in structural integrity.

5) At least one embodiment of POLYGONAL SGS's has four or more struts arranged in a generally radial (but not precisely radial) configuration. The struts are discontinuous in several variations of this embodiment and intersect at an internal or a peripheral point in other variations. The outward ends of the struts may be connected by guys at points which are the vertices of a tetrahedron in FIG 6A, a cube in FIG 6B and an octahedron in FIG 6C. The inner strut ends may form a skewed quadralateral in the tetrahedral version (FIG 6A), a rotated inner cube for the cubic version (FIG 6B), and a three sided twisted prism for the octahedral version (FIG 6C) of the illustrated POLYGONAL SGS's and other configurations for other polygons. The outer strut ends may be connected by guys such that an inward force is created and the inner strut ends are connected by guys resulting in an outward force which reacts the inward force resulting in structural integrity. FIGS. 6A, 6B, and 6C are only three of the many variations of the POLYGONAL SGS embodiment claimed by this invention. Inner and outer guy configurations may be claimed for the POLYGONAL SGS's as described below.

Figure 2A:
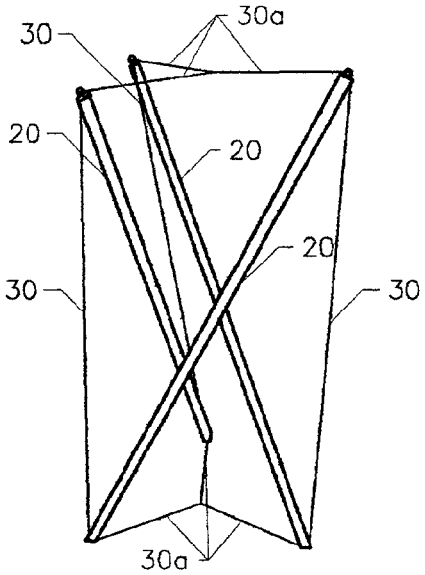
FIG. 2A is a 3 discontinuous strut HYPERBOLOID SGS with the "end-plane" guys (30*a*) configured in a radial arrangement as contrasted to FIG. 1A's circumferential arrangement. This radial arrangement requires only 58% of the length required in the circumferential arrangement of FIG. 1A.
Figure 2B:
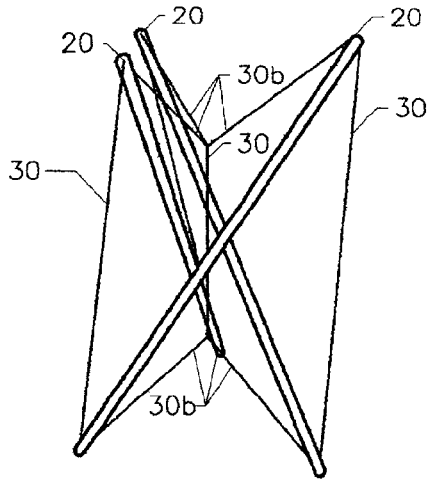
FIG. 2B is a 3 discontinuous strut HYPERBOLOID SGS with the "end-plane" guys (30*b*) configured in an internal arrangement as contrasted to FIG. 1A's circumferential arrangement. This guy configuration allows achievement of certain design goals not possible with the circumferential or radial arrangements.
Figure 2C:
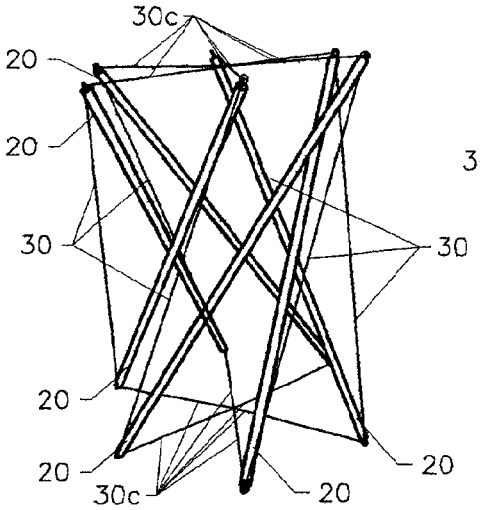
FIG. 2C is a 6 discontinuous strut HYPERBOLOID SGS with the "end-plane" guys (30*c*) configured in a radial arrangement.
Figure 2D:
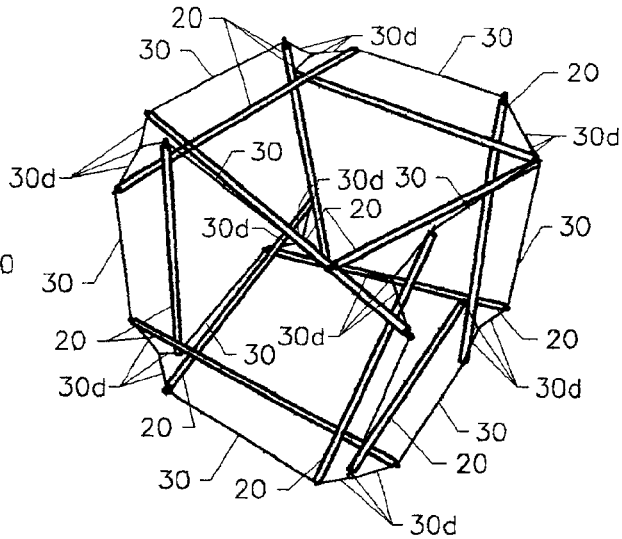
FIG. 2D is a 12 discontinuous strut composite HYPERBOLOID SGS where the struts are generally configured to form a rough cube with each corner truncated. The guys in each truncated corner (30*d*) are configured in a radial arrangement with the radial guy intersection points forming the exact vertices of a cube. Each strut in this composite structure is a member of two 3 discontinuous strut HYPERBOLOID SGS's each of which has an "end-plane" that forms the truncation of a corner of the cube.

In addition to the obvious linear guy arrangement, guy configurations (and combinations of these arrangements) which are claimed for each of the above strut configurations may be as follows:

1) A circumferential arrangement of guys can be used to connect the strut ends forming the "end-planes" of the HYPERBOLOID and the HY-PAR SGS's as well as the faces of the polygons formed by the strut ends of the PLANAR, RADIAL and POLYGONAL SGS's as shown in the figures. A circumferential arrangement of guys can be seen in FIGS. 5A, 5B, 6A and 6B.
2) A radial arrangement of guys can be used to connect the strut ends forming the "end-planes" of the HYPERBOLOID and the HY-PAR SGS's as well as the faces of the polygons formed by the strut ends of the PLANAR, RADIAL and POLYGONAL SGS's as shown in the figures. A radial arrangement of guys can be seen in the "end-planes" of FIGS. 2A, 2C, 2D, 4A, in eight of the twenty faces of the icosahedron of FIG. 3A (only eight faces are required to be radially guyed for structural integrity), and in four of the eight faces of the octahedron of FIG. 6C ( only four of the eight faces are required to be radially guyed for structural integrity).
3) An internal arrangement ( internal means internal to the faces of the polygons defined by the points of attachment of the guys to the outer strut ends) of guys can be used to connect the strut ends forming the "end-planes" in combination with the vertical guys of the HYPERBOLOID and the "end-plane" guys of the HY-PAR SGS's as well as the faces of the polygons formed by the strut ends of the PLANAR, RADIAL and POLYGONAL SGS's as shown in the figures. FIGS. 2B and 3B illustrate this internal arrangement of guys.

SELF-GUYED STRUCTURES (SGS's) can be utilized as stand-alone modules or modules can be combined by connecting them at any point on a strut or guy in a nested, or an adjacently attached configuration to assemble composite SGS's. Parts of one SGS can be combined with parts of another (e.g. one plane of the 3 discontinuous strut PLANAR with two planes of the HYP-PAR as well as many other combinations). These SGS's can also be combined with traditional structures. In these combinations it is sometimes possible to have a strut and/or a guy that is common to one or more of the combined structures thus allowing the elimination of the extra member(s) and thereby economizing on the total number of separate structural members.

At least one embodiment of these SGS's structures can be made collapsible by a suitable means of disconnecting guys from struts and/or elongating selected guys or shortening selected struts. The degree of pre-stress used to construct at least some embodiments of SGS's can be varied to achieve certain design goals.

While the above description contains many specificities, these should not be construed as limitations on the scope of the invention, but rather as an exemplification of one of the variations of the embodiments thereof. Many other variations of each embodiment of the invention are possible. Accordingly the scope of the invention should be determined not by the variations illustrated, but by the appended claims and their legal equivalents.

I claim:

1. A three-dimensional structure comprising:

at least three compression members situated on the surface of a first hyperboloid of revolution of one sheet having a mid-plane that is perpendicular to the conjugate axis of said first hyperboloid, wherein each said at least three compression members includes:

a first portion located on the surface of said first hyperboloid on one side of the mid-plane of said first hyperboloid; and a second portion located on the surface of said first hyperboloid on the other, second side of the mid-plane of said first hyperboloid;

a first set of at least three tension members that connect said first compression member portions with one another;

a second set of at least three tension members that connect said second compression member portions with one another; and a third set of at least three tension members that each connects at least one of said first compression member portions with at least one of said second compression member portions of a different compression member, wherein at least three tension members are configured in a radial configuration.

2. A three-dimensional structure as described in claim 1 wherein said at least three tension members configured in a radial configuration are of said first set of at least three tension members.

3. A three-dimensional structure as described in claim 1 wherein said at least three tension members configured in a radial configuration are of said second set of at least three tension members.

4. A three-dimensional structure as described in claim 1 wherein said third set of at least three tension members is situated on the surface of a second hyperboloid of revolution of one sheet.

5. A three-dimensional structure comprising:

at least three compression members situated on the surface of a first hyperboloid of revolution of one sheet having a mid-plane that is perpendicular to the conjugate axis of said first hyperboloid, wherein each said at least three compression members includes:

a first portion located on the surface of said first hyperboloid on one side of the mid-plane of said first hyperboloid; and a second portion located on the surface of said first hyperboloid on the other, second side of the mid-plane of said first hyperboloid;

a first set of at least three tension members that connects said first compression member portions with one another;

a second set of at least three tension members that connects said second compression member portions with one another; and a third set of at least three tension members that each connects at least one of said first compression member portions with at least one of said second compression member portions of a different compression member, wherein at least one tension member is configured in an internal configuration.

6. A three-dimensional structure as described in claim 5 wherein said at least one tension members configured in an internal configuration is of said first set of at least three tension members.

7. A three-dimensional structure as described in claim 5 wherein said at least one tension members configured in an internal configuration is of said second set of at least three tension members.

8. A three-dimensional structure as described in claim 5 wherein said at least one tension members configured in an internal configuration is of said first third of at least three tension members.

9. A three-dimensional structure as described in claim 5 wherein said third set of at least three tension members is situated on the surface of a second hyperboloid of revolution of one sheet.

10. A three-dimensional structure comprising:

at least four compression members that lie on the surfaces of only two different planes, wherein said only two different planes intersects, and a set of at least six tension members that connects each of said at least four compression members with at least one other compression member of said at least four compression members, wherein said three-dimensional structure comprising no compression members other than said at least four compression members.

11. A three-dimensional structure as described in claim 10 wherein at least one tension member is arranged in an internal configuration.

12. A three-dimensional structure as described in claim 10 wherein at least three tension members are arranged in a radial configuration.

13. A three-dimensional structure as described in claim 10 wherein at least one tension member is arranged in a circumferential configuration.

14. A three-dimensional structure comprising:

a first set of at least two compression members situated on the surface of a first hyperbolic paraboloid;

a second set of at least two compression members situated on the surface of a second hyperbolic paraboloid; and a set of at least twelve tension members which connect said compression members with one another, wherein said second hyperbolic paraboloid surface intersects said first hyperbolic paraboloid surface.

15. A three-dimensional structure as described in claim 14 wherein at least one of said at least twelve tension members is arranged in an internal configuration.

16. A three-dimensional structure as described in claim 14 wherein at least three of said set of at least twelve tension members are arranged in a radial configuration.

17. A three-dimensional structure as described in claim 14 wherein at least one of said set of at least twelve tension members is arranged in a circumferential configuration.

18. A three-dimensional structure comprising:

at least three compression members, wherein at least two of said at least three compression members are situated on the surface of a first hyperboloid of revolution of one sheet;

wherein at least one other compression member of said at least three compression members is situated on the surface of at least a second hyperboloid of revolution of one sheet, wherein each said hyperboloid of revolution of one sheet has a mid-plane that is perpendicular to the conjugate axis of the hyperboloid, and wherein each said at least three compression members includes:

a first portion situated on one side of the mid-plane of the hyperboloid upon which it is situated;

a second portion Situated on the other side of the mid-plane of the hyperboloid upon which it is situated;

a first set of at least three tension members that connect said first compression member portion, with one another;

a second set of at least three tension members that connect said second compression member portions with one another; and a third set of at least three tension members that each connect at least one of said first compression member portions with at least one of said second compression member portions of a different compression member.

19. A three-dimensional structure as described in claim 18 wherein at least one of said tension members is arranged in an internal configuration.

20. A three-dimensional structure as described in claim 18 wherein at least three of said tension members are arranged in a radial configuration.

21. A three-dimensional structure as described in claim 18 wherein at least one of said tension members are arranged in a circumferential configuration.

22. A three-dimensional structure as described in any one of claims 1, 5, 10, 14, or 18 wherein each of said compression members is straight.

23. A three-dimensional structure as described in any one of claims 1, 5, 10, 14, or 18 wherein each said tension members attaches ends of at least two compression members.

24. Compression members and tension members that are configurable to form the three-dimensional structure as described in any one of claims 1, 5, 10, 14, or 18.

* * * * *